US005127176A

United States Patent [19]

Newman

[11] Patent Number: 5,127,176

[45] Date of Patent: Jul. 7, 1992

[54] TENSIONAL FRAME WITH ROLLERS AND ELONGATED END PLUG SURFACES

[75] Inventor: Don E. Newman, Wyncote, Pa.

[73] Assignee: Stretch Devices, Inc., Philadelphia, Pa.

[21] Appl. No.: 609,303

[22] Filed: Nov. 1, 1990

[51] Int. Cl.[5] ..... D06C 3/08; B05C 17/08

[52] U.S. Cl. ..... 38/102.1; 38/102.91; 101/127.1

[58] Field of Search ..... 38/102, 102.1, 102.4, 38/102.91; 101/127.1, 128, 128.1, 415.1; 29/123; 160/327, 328, 329, 378, 395

[56] References Cited

U.S. PATENT DOCUMENTS

| | | | |
|---|---|---|---|
| 1,081,362 | 12/1913 | Cassity | 38/102.1 |
| 2,832,171 | 4/1958 | Batey | 38/102.91 |
| 3,226,861 | 1/1966 | Bird | 38/102.91 |
| 3,566,497 | 3/1971 | Hamlen | 29/123 |
| 3,601,912 | 8/1971 | Dubbs | 38/102.91 |
| 3,908,293 | 9/1975 | Newman | 38/102.91 |
| 3,982,345 | 9/1976 | Coleman | 160/378 X |
| 4,345,390 | 8/1982 | Newman | 38/102.91 |
| 4,409,749 | 10/1983 | Hamu | 160/378 X |
| 4,430,814 | 2/1984 | Wulc | 101/127.1 X |

*Primary Examiner*—Werner H. Schroeder
*Assistant Examiner*—Ismael Izaguirre
*Attorney, Agent, or Firm*—Seidel, Gonda, Lavorgna & Monaco

[57] ABSTRACT

A screen tensioning and printing frame having a plurality of rollers coupled at their ends to corner members. Each roller is also coupled to one edge portion of a screen material. The screen is tensioned by the rotation of the rollers about their longitudinal axis. Each roller includes at least one end plug having a series of engagement surfaces for causing rotation of the roller and a corresponding screen tension. The engagement surface being substantially elongated in the axial direction to increase the strength of the end plug upon rotation thereof by a wrench or the like.

19 Claims, 3 Drawing Sheets

FIG. 2
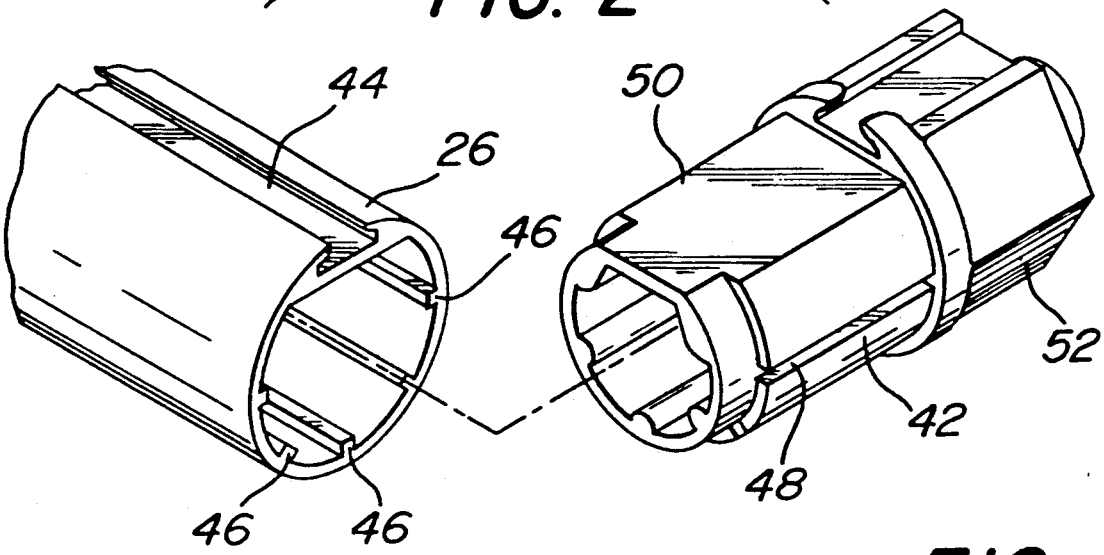
FIG. 3
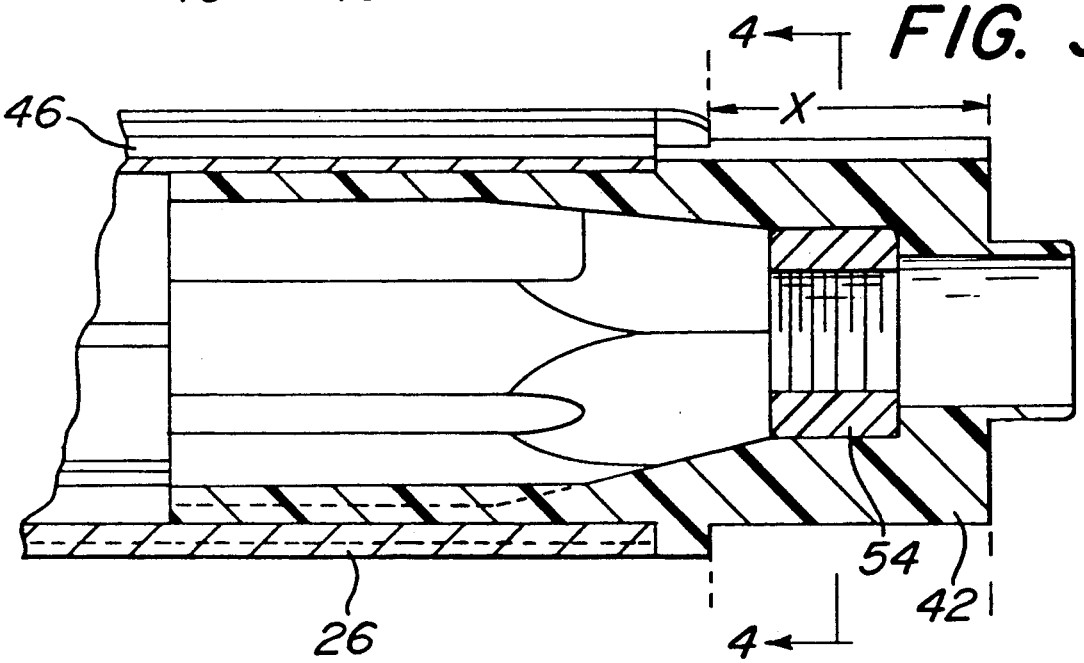
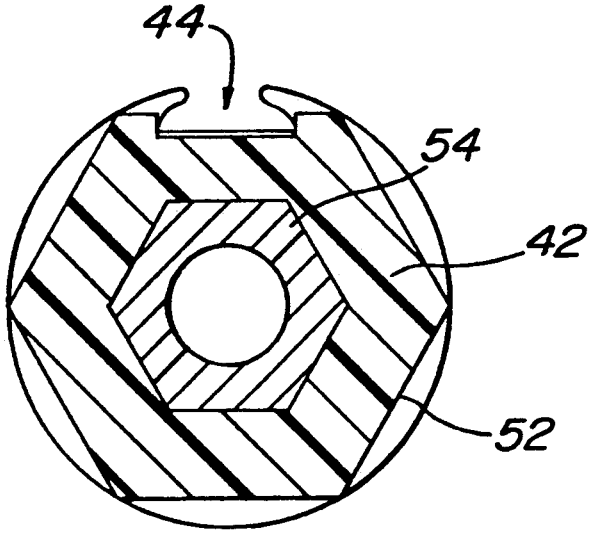
FIG. 4

FIG. 5
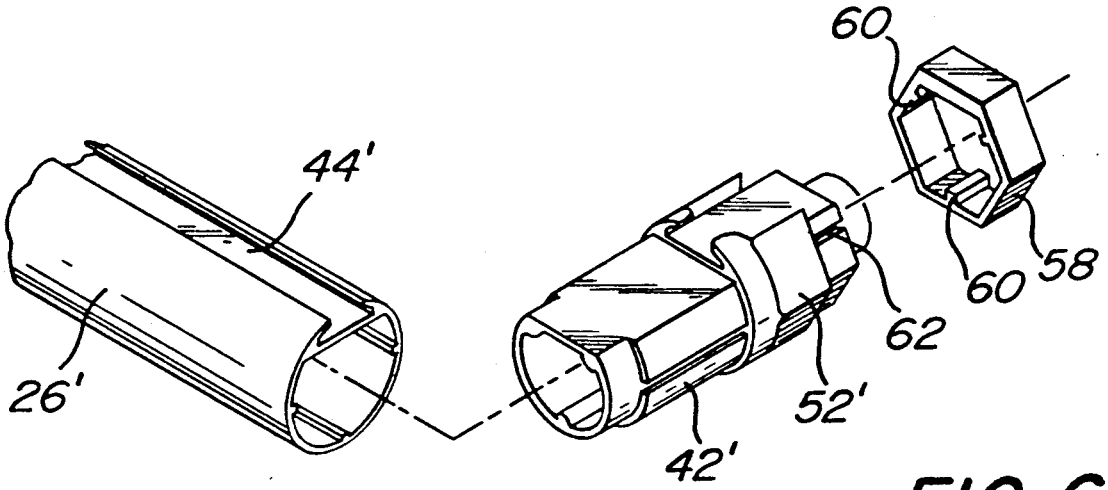
FIG. 6
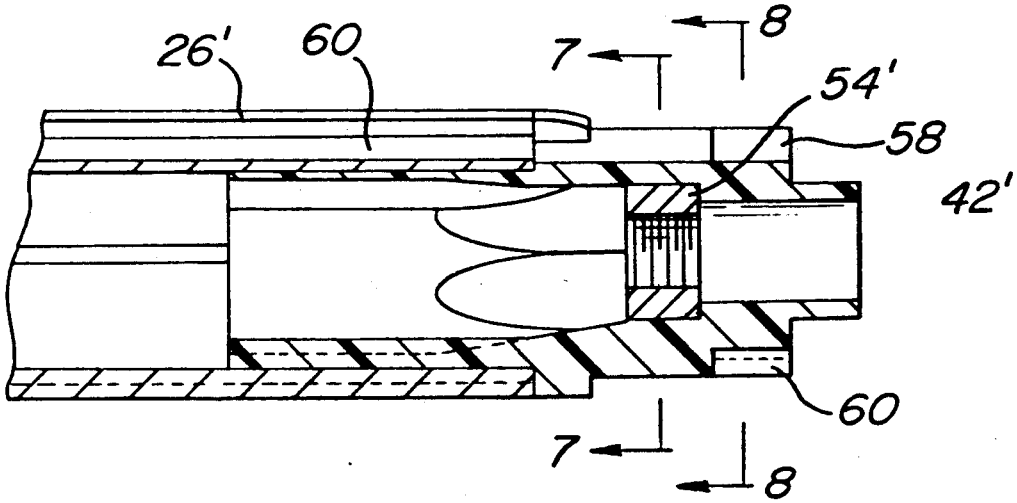
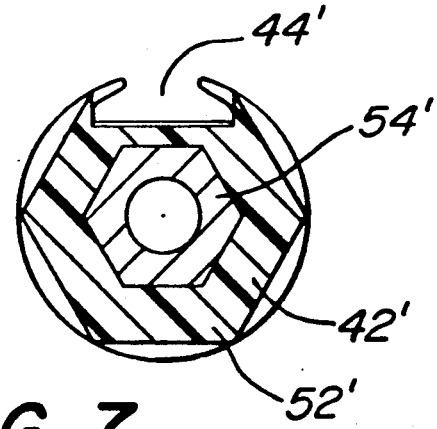
FIG. 7
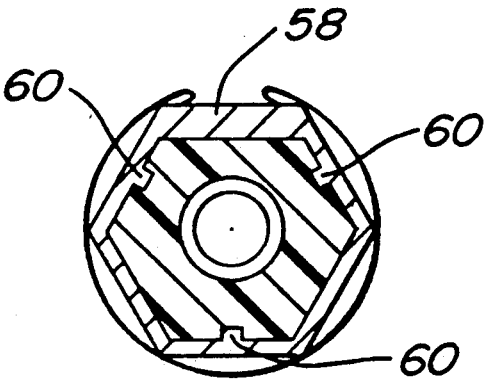
FIG. 8

TENSIONAL FRAME WITH ROLLERS AND ELONGATED END PLUG SURFACES

FIELD OF THE INVENTION

The present invention relates to an improvement in screen tensioning and printing frames. The present invention is directed to permitting the frame to tension the screen to ultra high tensions. In particular, the invention relates to the end plug portion of the roller member of a screen printing frame.

BACKGROUND OF THE INVENTION

The present invention is generally contemplated to be used along with the screen tensioning and printing frame members as described in U.S. Pat. No. 4,525,909. However, other members for a screen printing frame are also contemplated for use along with the present invention. Other examples of roller members and frames are described in U.S. Pat. Nos. 3,908,293; 4,430,815; and 4,430,814.

An apparatus for screen tensioning and printing generally comprises a frame typically having a plurality of roller members coupled together by corner members. The corner members support the rollers for rotation about their longitudinal axes. Each roller includes a longitudinally extending channel on its periphery so as to receive means to retain an edge portion of a screen fabric in the channel. Means is associated with each corner member for locking each roller in a predetermined rotative position so that the desired tension may be applied to the screen fabric. Moreover, means is provided on the end of each roller for causing the rotation of the roller about its longitudinal axis and creating the tension in the screen.

The roller portion of the printing frames generally includes an end plug positioned within a hollow extruded roller. The end plug generally includes an internal thread means for receiving the locking means for attaching the roller to the corner members. The external surfaces of the end plug generally form or include a hex nut type structure which may be engaged by a wrench or the like. The wrench member creates a torque about the longitudinal axis of the roller member, rotating the roller and tensioning the screen.

The present invention generally relates to the use of ultra high tension in the screen portion of the printing frame. An improved screen material for and method of screen printing is described in copending application Ser. No. 07/592,081, filed Oct. 3, 1990. However, known fabric or screen materials may also be utilized. Moreover, the support structures for a roller member of a screen tensioning and printing frame are contemplated to be utilized along with the present invention. Such support structures are described in U.S. Pat. No. 4,345,390.

The disclosure of each of the above-referenced patents and applications is herein incorporated by reference.

SUMMARY OF THE INVENTION

The present invention generally comprising hex nut engagement surfaces of the end plug that are elongated in an axial direction along the longitudinal axis of the roller. Moreover, a corresponding surface width of the wrench member associated with the hex nut of the roller member is contemplated. The combination of the elongated hex nut surfaces and the wrench member creates sufficient contact surface area so as to permit the ultra high tension within the screen member without failure of the end plug material.

The prior art end plugs were made of a relatively soft material (soft as compared to a stainless steel or the like) in which, although the effective size of the nut was substantially greater than the metal nut members known in the art, such material was of insufficient sheer and tensile strength to permit the tensioning as contemplated without an associated failure.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 2 shows an exploded view of a roller member and end plug as contemplated by the present invention.

FIG. 3 shows an axial cross-section of the end plug and roller combination illustrated in FIG. 2.

FIG. 4 shows a radial cross-section of the end plug illustrated in FIGS. 2 and 3.

FIG. 5 shows an exploded view of an alternate embodiment of a roller and end plug combination as contemplated by the present invention.

FIG. 6 is an axial cross-section of the end plug and roller member illustrated in FIG. 5.

FIG. 7 is a radial cross-section of the end plug illustrated by FIGS. 5 and 6.

FIG. 8 is a second radial cross-section of the end plug illustrated in FIGS. 5–7.

DESCRIPTION OF THE PREFERRED EMBODIMENTS

Figure 1:
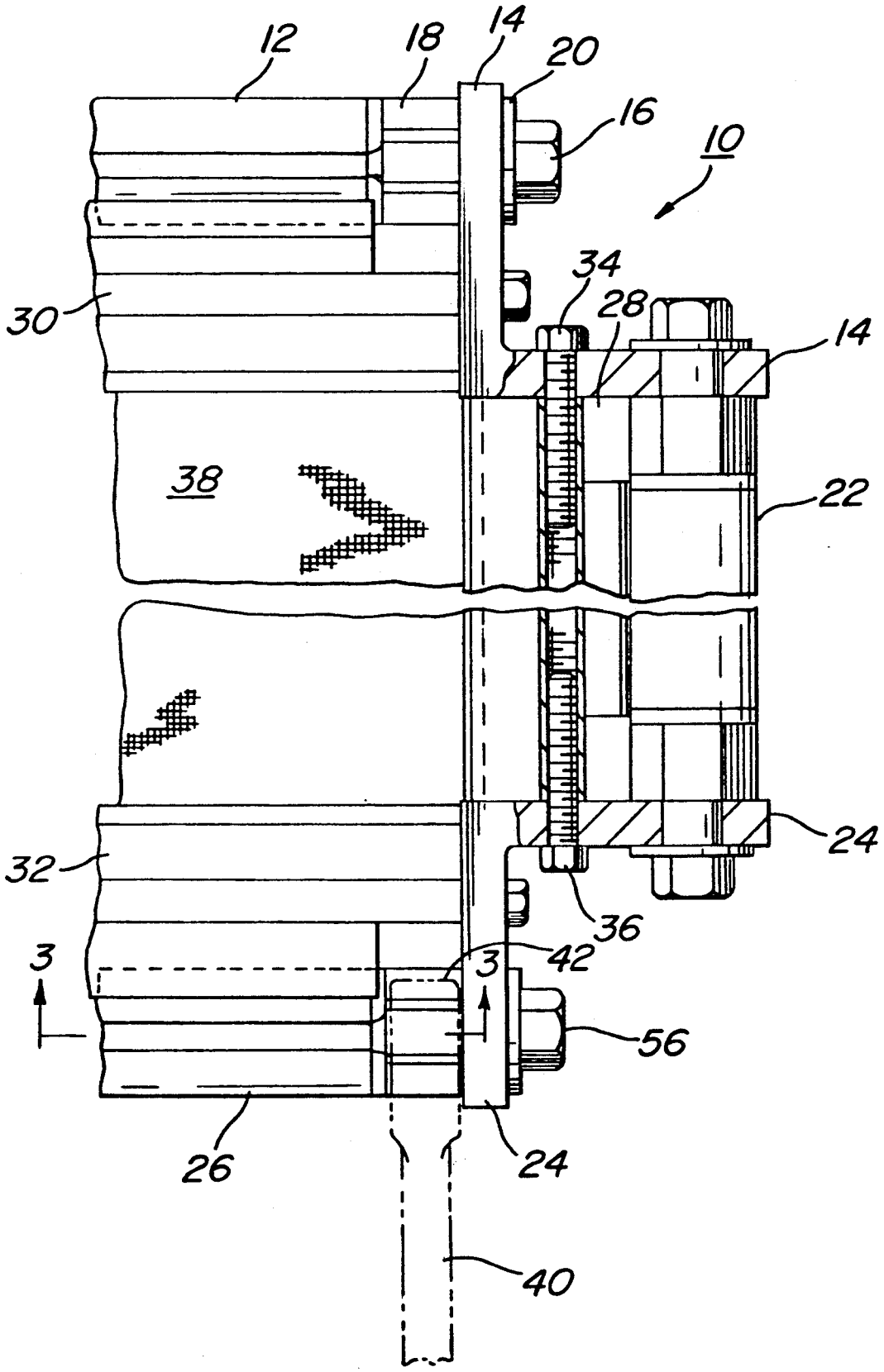
FIG. 1 shows a portion of a frame for tensioning a screen or fabric material for use in screen printing.

In the drawing where like numerals indicate like elements, there is shown a screen tensioning and printing frame which is generally referred to by the numeral 10. In FIG. 1, there is shown only a portion of frame 10. The frame 10 generally includes a series of rollers, three of which being shown in partial view. The first roller 12 is attached to a corner member 14 by means of a bolt 16 which engages internal threads (not shown in FIG. 1) within an end plug 18. End plug 18 is inserted within the first roller member 12. A washer 20 is positioned between the head of bolt 16 and the corner member 14 to provide a bearing surface upon torquing the bolt 16 into the threads of the end plug 18.

Attached to the corner member 14 is a second roller 22. The first roller 12 and second roller 22 are generally perpendicular to one another. The second roller 22 is of substantially the same construction as the first roller 12. The opposite end of the second roller 22 is attached to a second corner member 24. Attached to the second corner member is a third roller member 26. The opposite ends of first roller 12 and third roller 26 are also attached to respective corner members (not shown) and include a fourth frame member, which may or may not be a fourth roller member (not shown).

Associated with each roller 12, 22 and 26, as illustrated, is a box beam or support structure. The box beams are generally contemplated to be made in accordance with the above-referenced U.S. Pat. No. 4,345,390. For illustration purposes, in FIG. 1, the box beam 28 is illustrated in cross-section adjacent to the second roller member 22. Box beams 30 and 32 are also illustrated in association with roller members 12 and 24, respectively. Box beam 28 is attached to the corner member 14 by means of bolt 34. The opposite end of box beam 28 is attached to corner member 24 by a second bolt 36. Box beams 30 and 32 generally include a similar-type structure.

A screen material 38 is attached at adjacent edges to the respective roller members 12, 22 and 26, respectively. The screen material as contemplated by the present invention may be made in accordance with application Ser. No. 07/592,081, filed Oct. 3, 1990, or as generally known in the art. The tension in the screen material is generally created by the rotation of the rollers 12, 22 and 26, respectively, about their longitudinal axes. The tension is maintained by locking the rollers at a predetermined rotated position by means of the bolt 16. Means may be provided for incremental adjustment of the relative end-to-end position of the roller members as in accordance with application Ser. No. 07/403,544, filed Sep. 6, 1989. This application is herein incorporated by reference.

A wrench 40 is shown engaged with the surfaces of end plug 42 associated with roller member 26 attached to corner member 24. The wrench 40 is generally contemplated to cause the rotation of the roller member 26 about its longitudinal axis so as to create tension in the screen material 38. The construction of the end plug 42, as well as end plug 18 and those associated with roller member 22, will be discussed with respect to FIGS. 2-8 below.

FIGS. 2, 3 and 4 generally show one embodiment of an end plug and roller member as contemplated by the present invention. In FIG. 2, there is illustrated a roller 26 and its associated end plug 42. The roller generally includes an elongated locking channel 44 on the periphery thereof. The internal surfaces of the hollow roller 26 include a series of ribs 46 which project radially inwardly at various positions. The roller members are generally contemplated to made of an aluminum material by an extrusion process. Rib members 46 serve to stiffen the roller and fixedly couple the end plug to the roller to prevent slippage. The locking channel 44 is preferably made in accordance with U.S. Pat. No. 4,525,909.

The end plug 42 is formed such that a portion thereof fits within the hollow portion of the roller 26. The end plug 42 generally includes a series of slots 48 which are adapted to receive ribs 46 of the roller 26. Moreover, a flat or engagement surface 50 is provided to permit the end plug 42 to fit within the roller. Surface 50 is generally positioned within the roller adjacent to the internal surfaces which form the locking groove 44. At the opposite end of the plug member 42 is a hex nut arrangement 52. The hex nut 52 is exposed when the end plug 42 is placed within the hollow of roller member 26. Hex nut 52 provides a series of engagement surfaces which when engaged by wrench 40, or the like, can cause the roller to rotate about its longitudinal axis.

As illustrated in FIG. 3, positioned within the hollow portion of the end plug 42 is a nut 54. Nut 54, also illustrated in FIG. 4, is hexagonally shaped and fits within a corresponding channel within the end plug 42. The nut 54 is generally adapted to receive bolt 56 so as to lock the roller 26 to the corner member 24 and to define the predetermined rotated position of the roller 26. The engagement between the end plug 42 and the internal surfaces of roller 26 is generally contemplated to seal the internal surfaces of the roller. The engagement between bolt 56 and the nut 54 is also intended to seal the passageway through the nut 54.

The end plug 42, as generally contemplated by the present invention, may be made by any material as desired. However, in viewing weight and cost considerations, a plastic-type material is generally preferred. The use of a plastic- or nylon-type material for end plugs is known. However, the use of this type material generally limits the tension that may be applied to a screen, since the engagement between the wrench, such as wrench 40, and the end plug 42 may be unable to provide sufficient torque without failure of the hex nut portion 52. It is also contemplated that an aluminum material or a zinc material may be utilized. The invention may also include a steel end plug, if desired.

The preferred material as contemplated by the present invention is a nylon 6/6 material such as the THERMOCOMP (registered trademark) RF series as manufactured by LNP Engineering Plastic. The preferred material is identified by the Ser. No. RF-100-10 and includes a 50% glass full content. This material has an overall specific gravity of approximately 1.57 and a specific volume of 17.6 cubic inches per pound. The tensile strength is approximately 32,000 psi. The tensile elongation of the material is approximately 2% to 3% with a flexural strength of approximately 46,500 psi. The flexural modulus is 2,200,000 psi, and the compressive strength is approximately 27,000 psi. The shear strength is approximately 13,300 psi. Its Izod impact strength in foot pounds per inch is approximately 3.3 for a notched $\frac{1}{4}'' \times \frac{1}{2}''$ bar and 20 for an un-notched $\frac{1}{4}'' \times \frac{1}{2}''$ bar. The Rockwell hardness, as determined by ASTM method D786, is R121/M100. Other suppliers of this type material are also contemplated, such as DuPont and Adell Plastics Inc. of Baltimore, MD. Certain variations in the tensile strength may be incorporated into this material as the subject of its glass content and/or its amount of virgin nylon utilized. Lower glass content may also be utilized if the desired strength characteristics are maintained.

A number of embodiments are contemplated by the present invention. These embodiments particularly relate to the outside diameter of the roller and the desired tension in the screen. However, it is contemplated that tensions to approximately 100 newtons per centimeter are possible. An important dimension with respect to the present invention is the axial length of the flat surfaces of the hex nut. Because of the amount of torque that is being applied by the wrench 40 and the material used to form the end plug, the length of these surfaces generally determines the overall strength of the hex. It should be noted that the length and overall position of the flat surfaces from the longitudinal axis of the roller is generally unrelated to the shear strength of the threads within the nut 54. It is generally contemplated that the number of threads required to lock the roller in its predetermined rotated position by means of bolt 56 will not need to be substantially increased as a result of the increase in tension in the screen. Manifestly, the present invention does not particularly relate to the number of threads or the size of the nut 54.

The following is a chart of the variation in the axial length of the flat surfaces of the hex nut portion of the end plug in the prior art as compared to that contemplated by the present invention. These figures are identified as a function of the diameter of the roller members.

| Roller Diameter | Prior Hex Axial Length | Improved Hex Axial Length |
|---|---|---|
| 1.6" | 0.6" | 1.025" |
| 1.3" | — | 0.75" |
| 1.0" | 0.5" | 0.75" |

An important feature of the present invention is the simultaneous elongation of the wrench for contacting the flat surfaces of the hex nut portion 52 of the end plug 42. In a typical wrench, the width is generally fixed for a specific opening (or hex nut size). The width of a nut is typically fixed for a certain number of threads. The wrench size is also relatively thin as compared to the nut width. An elongation of the hex nut surfaces of an end plug 42 without a simultaneous elongation of the wrench results in the contact surface area being substantially the same. Thus, the failure point would also remain the same. Manifestly, the present invention contemplates an elongation of the wrench so as to increase the contact surface area and the overall strength of the end plug when tensioning the screen material by rotating the roller.

Illustrated in FIGS. 5–8 is an alternate embodiment of the end plug as contemplated by the present invention. In this embodiment, the outside diameter of the roller 26' is typically contemplated to be at the lower end of the above chart. However, this structure may be used on any size roller, as desired. The locking groove 44' in roller 26', as shown, is generally contemplated to be of the same dimensions as that illustrated in the embodiments shown in FIGS. 2–14. Because the locking channel 44' in roller 26' is generally the same width as that contemplated in the larger roller, the space provided on the end plug 42' adjacent the locking channel 44' for removal of the locking member (not shown), encompasses substantially all of the one flat surface on the hex nut portion 52'. Manifestly, a weak link is provided with respect to torquing the roller 26' to tension the screen.

In order to avoid the undesirable condition whereby the tensioner of the screen material would have to identify which specific surface would be contacted by the wrench in order to tension the screen material or whereby a flat would not be available (depending on the position of the nut), a composite hex nut surface is provided. A metal ring 58 is provided on the end of the end plug 42' and forms a portion of the flat surfaces of the hex nut 52'. Ribs 60 may be provided on the internal surfaces of ring 58. Ribs 60 engage slots 62 in the end plug 42'. This structure results in an overall strengthening of the hex nut 52' composite construction.

Ring 58 is generally contemplated to be made of a metal material, such as aluminum and/or stainless steel. Moreover, the ring 58 is generally contemplated to be sufficient for withstanding the force of the wrench on nut. Moreover, the ring may extend across the entire engagement surface of the hex nut 52' of the end plug 42'. This embodiment would still be a composite structure since the ring surrounds the softer material. It is contemplated that the composite hex nut structure need not necessarily be elongated as in non-composite structure. However, in the embodiment shown in FIG. 5, there is an elongation so as to provide room for the locking strip (not shown) to be removed from the locking groove 44'.

It should be noted that the preferred embodiment of the present invention, incorporating the plastic-type material, would also substantially increase the nominal diameter of the hex nut portion of the end plug in order to again increase the overall surface area and thus the strength of the end plug when creating tension in the screen. Again, the number of threads per inch in the nut 54 and 54' is not necessarily required to be increased as a result of this increased screen tension. Also, the increase in the axial length of the hex nut is contemplated to be accompanied by an increase in the overall width of the wrench. It is generally contemplated that the width of the wrench will correspond to the axial length of the surfaces of the hex nut portion.

The present invention may be embodied in other specific forms without departing from the spirit or essential attributes thereof and, accordingly, reference should be made to the appended claims, rather than to the foregoing specification, as indicating the scope of the invention.

I claim:

1. A screen tensioning and printing frame comprising: a plurality of elongated rollers each having two ends, a plurality of corner members, the ends of the rollers coupled to the corner members, means for coupling the rollers to the corner members such that the rollers are rotatable about their longitudinal axes, the coupling means releasably locking the rollers to the corner members at a predetermined rotated position, a screen material coupled to the rollers such that a rotation of said rollers about their axes causes a tensioning in the screen material, the coupling means locking the roller at a tension corresponding to the rotated position of the rollers, and end plug means on at least one end of the rollers, the end plug means including engagement surfaces for receiving means for causing rotation of the roller and a corresponding screen material tension, the engagement surfaces being generally elongated in the axial direction of the roller, whereby the strength of the end plug means is increased for purposes of tensioning the screen material.

2. A screen tensioning and printing frame as claimed in claim 1 wherein the end plug means is made of a glass-filled nylon material and wherein the coupling means includes a nut mounted within the end plug means and a bolt for coupling the end plug means to the corner member by engagement with the nut.

3. A screen tensioning and printing frame as claimed in claim 1 further comprising means for supporting the rollers to prevent undesired inward bowing due to the tension of the screen material.

4. A screen tensioning and printing frame as claimed in claim 1 further comprising locking means associated with the roller for securing the screen material to the roller.

5. A screen tensioning and printing frame as claimed in claim 1 wherein the roller members have an outside diameter of approximately 1.6 inches, the end plug means having a nominal diameter substantially the same as the diameter of the roller, and the engagement surfaces of the end plug extended in the axial direction in excess of 0.6 inches.

6. A screen tensioning and printing frame as claimed in claim 5 wherein the length of engagement surfaces of the end plug means is approximately 1.0 inches.

7. A screen tensioning and printing frame as claimed in claim 1 wherein the outside diameter of the rollers is approximately 1.3 inches, the end plug means has a nominal diameter substantially the same as the diameter of the rollers, and the engagement surfaces of the end plug are extended in the axial direction for approximately 0.75 inches.

8. A screen tensioning and printing frame as claimed in claim 1 wherein the outside diameter of the rollers is approximately 1.0 inches, the end plug means has a nominal diameter substantially the same as the diameter of the rollers and the engagement surfaces of the end plug are extended in the axial direction in excess of 0.5 inches.

9. A screen tensioning and printing frame as claimed in claim 8 wherein the length of the engagement surface of the end plug means are approximately 0.75 inches.

10. A screen tensioning and printing frame as claimed in claim 1 wherein the rollers are made of an extruded aluminum and the end plug means is made of either aluminum of zinc.

11. A screen tensioning and printing frame as claimed in claim 1 wherein the engagement surfaces of the end plug means include at least a portion thereof formed by a ring made of a material substantially stronger than the remaining material of the end plug means.

12. A screen tensioning and printing frame comprising: a plurality of elongated rollers each having two ends, a plurality of corner members, the ends of the rollers coupled to the corner members, means for coupling the rollers to the corner members such that the rollers are rotatable about their longitudinal axes, the coupling means releasably locking the rollers to the corner members at a predetermined rotated position, a screen material coupled to the rollers such that the rotation of said rollers about their axes causes a tensioning in the screen, the coupling means locking the rollers at a tension corresponding to the rotated position of the rollers, and end plug means on at least one end of the rollers, the end plug means including engagement surfaces for receiving means for causing rotation of the roller and a corresponding screen tension, the engagement surfaces being generally elongated in the axial direction of the roller, the end plug means made of a plastic-type material and the engagement surfaces comprise a composite structure of plastic and aluminum, whereby the strength of the end plug means is increased for purposes of tensioning the screen material.

13. A screen tensioning and printing frame as claimed in claim 12 wherein the plastic material is a glass-filled nylon material.

14. A screen tensioning and printing frame as claimed in claim 13 wherein the material of the end plug has a tensile strength of approximately 32,000 psi and a shear strength of approximately 13,300 psi.

15. A screen tensioning and printing frame as claimed in claim 12 wherein the aluminum portion of the composite engagement surface comprises a ring.

16. A screen tensioning and printing frame comprising: a plurality of elongated rollers each having two ends, a plurality of corner members, the ends of the rollers coupled to the corner members, means for coupling the rollers to the corner members such that the rollers are rotatable about their longitudinal axes, the coupling means releasably locking the rollers to the corner members at a predetermined rotated position, a screen material coupled to the rollers such that the rotation of said rollers about their axes causes a tensioning in the screen, the coupling means locking the rollers at a tension corresponding to the rotated position of the rollers, and end plug means on at least one end of the rollers, the end plug means including engagement surfaces for receiving means for causing rotation of the roller and a corresponding screen tension, the engagement surfaces being generally elongated in the axial direction of the roller, the engagement surfaces comprising a composite structure having one portion made of a plastic material and another portion made of a metal material, whereby the strength of the end plug means is increased for purposes of tensioning the screen material.

17. A screen tensioning and printing frame as claimed in claim 16 wherein the metal portion forms a ring.

18. A screen tensioning and printing frame as claimed in claim 16 wherein the metal material is made from the group consisting of aluminum, zink and steel.

19. A screen tensioning and printing frame comprising: a plurality of elongated rollers each having two ends, a plurality of corner members, the ends of the rollers coupled to the corner members, means for coupling the rollers to the corner members such that the rollers are rotatable about their longitudinal axes, the coupling means releasably locking the rollers to the corner members at a predetermined rotated position, a screen material coupled to the rollers such that the rotation of said rollers about their axes causes a tensioning in the screen, the coupling means locking the rollers at a tension corresponding to the rotated position of the rollers, and end plug means on at least one end of the rollers, the end plug means including engagement surfaces for receiving means for causing rotation of the roller and a corresponding screen tension, the engagement surfaces being generally elongated in the axial direction of the roller, the end plug means made of a glass-filled nylon material, the coupling means including a nut mounted within the end plug means and a bolt for coupling the end plug means to the corner member by engagement with the nut, the material of the end plug having a tensile strength of approximately 32,000 psi and a sheer strength of approximately 13,000, 1,300 psi.

* * * * *